US005758443A

United States Patent [19]

Pedrazzini

[11] Patent Number: 5,758,443

[45] Date of Patent: Jun. 2, 1998

[54] PATIENT IDENTIFICATION DEVICE

[75] Inventor: Gianandrea Pedrazzini, Segrate, Italy

[73] Assignee: Healtech S.A., Balzers, Liechtenstein

[21] Appl. No.: 586,830

[22] PCT Filed: Jul. 29, 1994

[86] PCT No.: PCT/EP94/02516

§ 371 Date: May 16, 1996

§ 102(e) Date: May 16, 1996

[87] PCT Pub. No.: WO95/04343

PCT Pub. Date: Feb. 9, 1995

[30] Foreign Application Priority Data

Aug. 3, 1993 [IT] Italy ..... MI93A1761

[51] Int. Cl.[6] ..... G09F 3/14; B65D 63/00

[52] U.S. Cl. ..... 40/633; 40/665; 40/640; 24/16 PB

[58] Field of Search ..... 40/633, 640, 665, 40/300, 304, 6; 24/16 PB, 16 R, 176

[56] References Cited

U.S. PATENT DOCUMENTS

| | | | |
|---|---|---|---|
| 1,851,491 | 3/1932 | Brown . | |
| 2,846,796 | 8/1958 | Polzin . | |
| 3,397,430 | 8/1968 | Pearl | 24/16 PB |
| 3,818,897 | 6/1974 | Smith . | |
| 4,464,854 | 8/1984 | Hall | 40/633 |
| 4,506,415 | 3/1985 | Swift | 40/665 X |
| 5,153,416 | 10/1992 | Neeley . | |
| 5,377,387 | 1/1995 | Freed | 24/16 PB |
| 5,537,719 | 7/1996 | Freed | 24/16 PB |

FOREIGN PATENT DOCUMENTS 2397801 2/1979 France .

*Primary Examiner*—Kenneth J. Dorner
*Assistant Examiner*—Cassandra Davis
*Attorney, Agent, or Firm*—Sixbey Friedman Leedom & Ferguson; Gerald J. Ferguson, Jr.; Thomas W. Cole

[57] ABSTRACT

A support device of information for the identification of hospital in- or out-patients is provided in the form of a strip of flexible material that can be wound on the end of limbs or round the neck of the patient like a bracelet or collar. The device includes an element for clamping the two free ends of the strip together formed from a first part and a second part cooperating one with the other and with the free ends of the strip to ensure a permanent adjustable clamping of the bracelet or of the collar. The first part of the element has a flat surface suitable for receiving and storing for a subsequent reading information suitable for the identification of the patient.

8 Claims, 3 Drawing Sheets

PATIENT IDENTIFICATION DEVICE

BACKGROUND OF THE INVENTION

The present invention relates to a support device of information that can be associated with hospital in- or out-patients for their automatic and univocal identification.

The need is known of being able to associate in a univocal manner with a given patient, either a hospital in-patient or subject to an out-patient treatment, everything that derives from him or her, such as for example a biological sample to be analyzed or a document related to an instrumental test, or referring to him, such as for example a drug or an instrumetal therapeutic treatment.

This need can be met by automating in a closed cycle the different steps through which the patient is made to go, starting with his identification at the time of admittance up to, for example, the taking of a blood or other biological sample and to the execution of a test, to the administration of a drug or to the execution of a therapy.

In the international patent application No. WO 92/01268, No. WO 92/10985 and No. WO 93/08735, all in the name of the applicant, it is highlighted that the step of patient identification, recurring and necessary every time a medical act is performed, is the source of serious, sometime irreparable, errors; this is due to the fact that the patient is frequently identified indirectly, for example by the number of the occupied bed or with other fictitious and interchangeable markings, or because there is a temporal discontinuity between identification and the execution of the medical act itself. This translates into a possible switch of information relating to different patients.

In the first of the mentioned patent applications a method, and a related apparatus, is described, for associating to a patient identified by a personal code, in a univocal and permanent manner, some containers for medical use, for example test tubes for containing biological samples to be analyzed.

In the second of the mentioned patent applications the problem of administering drugs to patients is tackled and solved.

The third of the mentioned patent applications describes a method for associating the identification code of a patient to diagnostic images in general, such as for example the results of an X-ray test.

The solutions described in the three mentioned patent applications are based on the existence of a device that is attached to the patient and that comprises a support on which information useful for a univocal identification of the patient himself is recorded. Every medical act to which the patient is subjected requires as the initial step the identification of the patient through the automatic reading of the information recorded on such support, identification that is thus ensured independently of the co-operation of the patient himself or of errors caused by inattention of the health operators.

The object of the present invention is to obtain a support device of information, that can be associated with patients for their automatic and univocal identification, that can be used in combination with the apparata described in the abovementioned patents.

SUMMARY OF THE INVENTION

According to the present invention, such object is attained thanks to a device for the identification of a hospital in- or out-patient, characterized in that it comprises a strip of flexible material that can be wound on the end of limbs or round the neck of said patient like a bracelet or collar, and an element for clamping the two free ends of said strip together comprising a first part and a second part co-operating one with the other and with said free ends of the strip to ensure a permanent adjustable clamping of the bracelet or of the collar, where said first part has a flat surface suitable for receiving and storing for a subsequent reading information suitable for the identification of said patient.

Thanks to the present invention, it is possible to obtain a support device for information that can be associated in a permanent manner with hospital in- or out-patients at the time when they enter the hospital's in- or out-patient circuit, that allows their univocal identification and that cannot be removed either accidentally or intentionally while the patient remains in the hospital or while he is subjected to treatment without this becoming obvious to health operators. The design of the clamping element in two distinct parts, only one of which acts as the support for the storage of identification information, makes for easier operations for storing said information on the part of the apparatus designed for the purpose, and the presence of said flat surface simplifies reading operations. It is moreover possible to record on said part of the clamping element both coded information that can be read by suitably-equipped machines and clear information that can be read by man.

BRIEF DESCRIPTION OF THE DRAWINGS

These and other features of the present invention will be made more evident by the following detailed description of two embodiments thereof, illustrated as non-limiting examples in the enclosed drawings, wherein.

DETAILED DESCRIPTION OF THE PREFERRED EMBODIMENT

Figure 1:
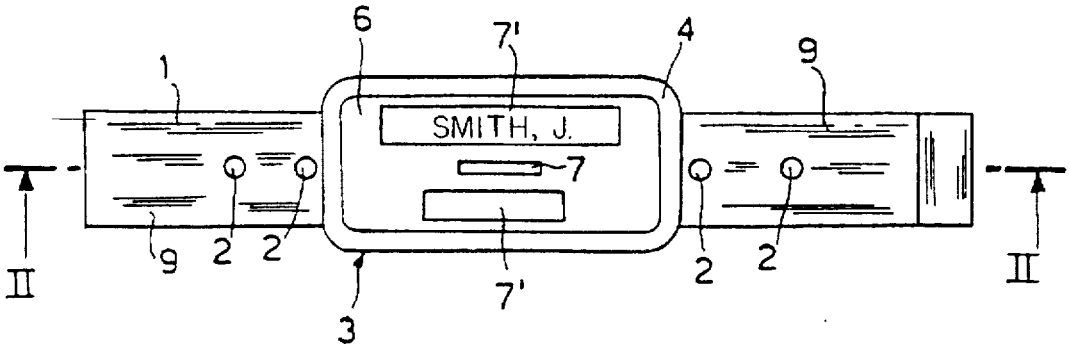
FIG. 1 is a plan view from above of a device according to one embodiment of the invention.
Figure 2:
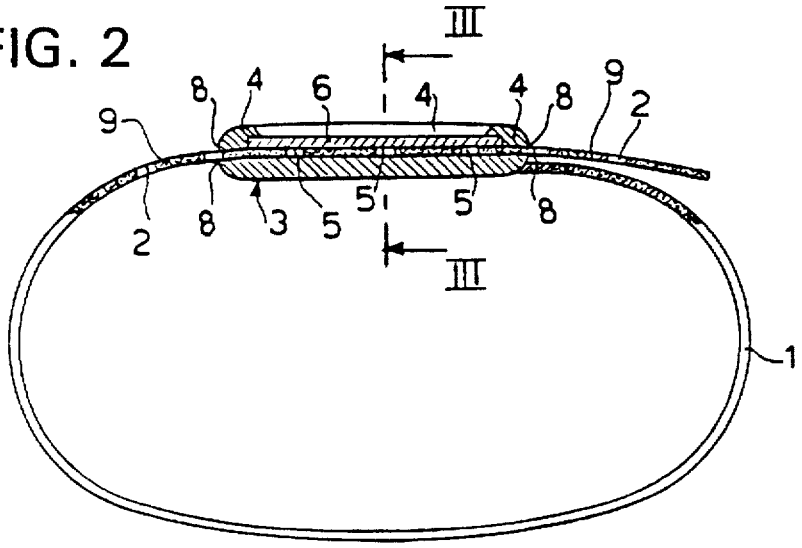
FIG. 2 is a cross-sectional view of said device taken along the line II—II of FIG. 1.
Figure 3:
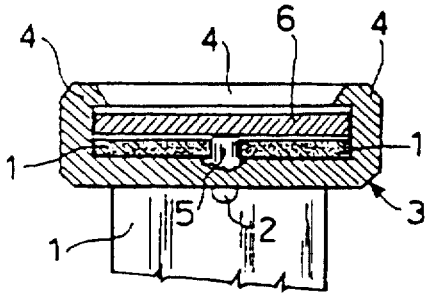
FIG. 3 is a cross-sectional view of said device taken along the line III—III of FIG. 2.

An identification device according to a first embodiment of the invention, shown in FIGS. 1–3, comprises a strap 1 of flexible material, for example made of plastic material that is non-toxic for man, in an end section 9 of which there are through holes 2 in a longitudinal succession, while welded at the opposite end there is an element 3 of a rectangular shape that is hollow in the middle, also made of plastic material that is non-toxic for man and provided at the rims with a frame 4, wherein on two transversal sides there are also two slits 8 suitable for allowing the passage of the free end 9 of the strap 1. The bottom of said element 3 is shaped so as to give rise to teeth 5 with a longitudinal pitch coinciding with that of the through holes 2 of the strap 1 and suitable for engaging in the latter, when the strap 1 is folded back on itself to be wound in an adjustable manner round the end of a limb or the neck of the patient. A small rectangular tag 6 acts as the support for storing the patient's identification information, information that is recorded in a digital format readable by an optical reader in an area 7 of the tag 6 and possibly also in a format that can be read by man in further areas 7' of the same tag 6. That tag 6 has dimensions that are substantially corresponding to those of the hollow bottom of the element 3, although they are slightly larger, so that it can be inserted in said hollow bottom by pressure and consequent elastic deformation of the frame 4.

The recording of information in a digital format on the tag 6 can for example take place according to the technique described in the already-mentioned international patent application No. WO 92/01268, by means of a laser generator or an engraving point, to define a bit matrix in the area 7 that is sufficient for storing the information in a coded form; in the case of a patient having Italian nationality, the corresponding tax code number can be used, in which case it is necessary to have a 73-bit matrix.

Reading the information stored on the small tag 6 can take place by means of an optical reader, for example a television camera.

When a patient is admitted to a hospital or an out-patient surgery, a tag 6 is issued that contains the information relating to the patient necessary for his subsequent univocal identification. Information is recorded on the tag 6 in a digital form and possibly also in a form that is readable by man.

The strap 1 is then wound on a wrist or the end of another limb or even round the neck of the patient, if it's a case of an amputee, whose end 9 provided with through holes 2 is inserted into the slits 8 so that the teeth 5 enter the through holes 2 in an adjustable position according to the diameter of the patient's wrist or neck. The tag 6 is then inserted into the element 3, by simple finger pressure, that determines the clamping of the strap 1, whose axial sliding motion is prevented by the teeth 5 that are kept in an engaged condition in the through holes 2 by the tag 6. The latter cannot be removed from its housing seat, except by damaging either the tag itself or the element 3.

Every subsequent medical act to which the patient is to be subjected is preceded by the reading of the identification information stored in code on the tag 6.

At the end of the hospital in- or out-patient cycle, the device is removed by cutting the strap 1.

Figure 4:
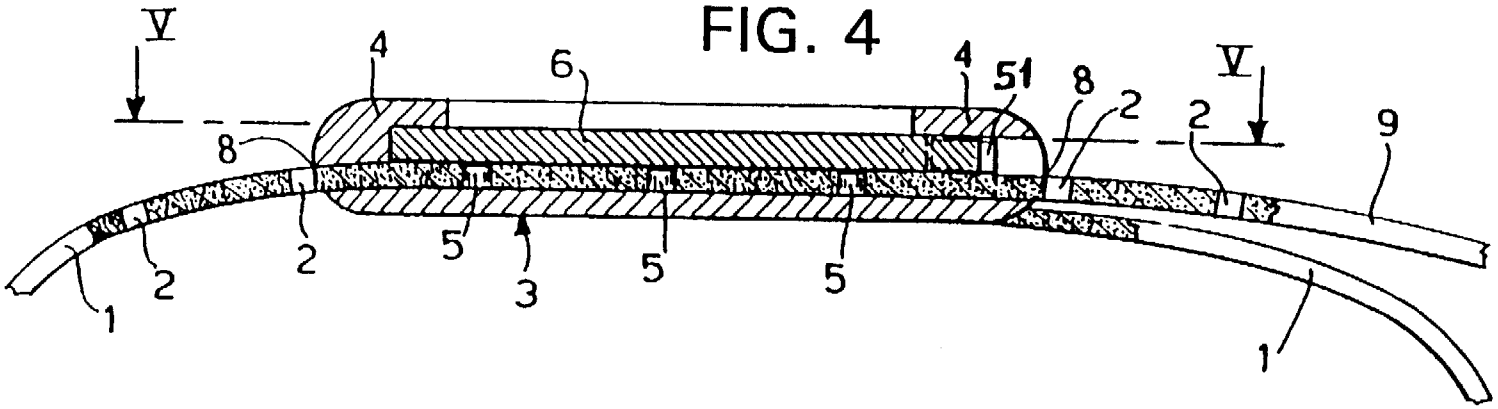
FIG. 4 is a cross-sectional view, similar to FIG. 2, of a device according to a different embodiment of the invention.
Figure 5:
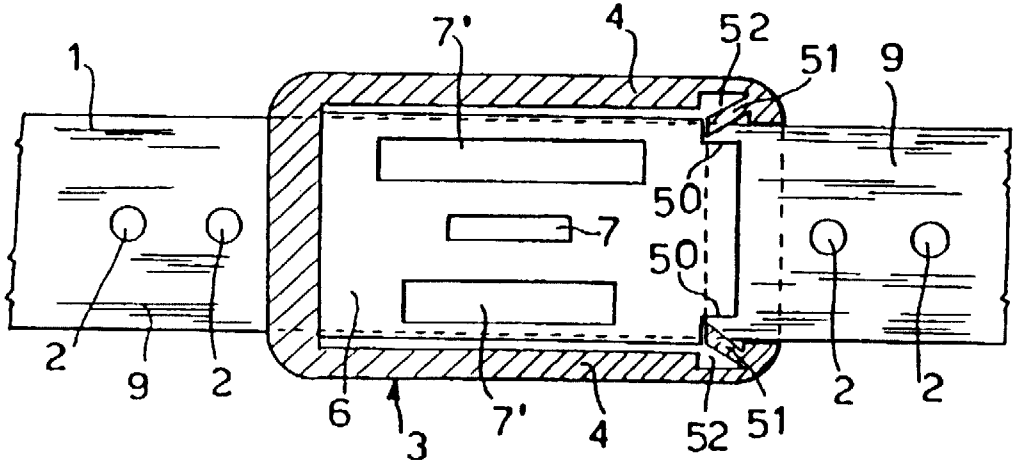
FIG. 5 is a cross-sectional view taken along the line V—V of the device of FIG. 4.

As an alternative to the vertical insertion of the tag 6, with the object of preventing the axial sliding motion of the strap 1, an insertion in the longitudinal direction parallel to the strap 1 itself can be made. In this case the tag 6 will have notches 50 again distributed along the longitudinal insertion sides, that in FIG. 4 are represented simply at two corners so that, when insertion has taken place, they receive the teeth 51, elastically protruding toward the inside of the frame 4 and temporarily displaced by the tag 6 inside the receiving seats 52. When insertion is completed, the teeth 51 return to their natural position thus preventing accidental or intentional extraction except with evident damage to the bracelet's main part.

Figure 6:
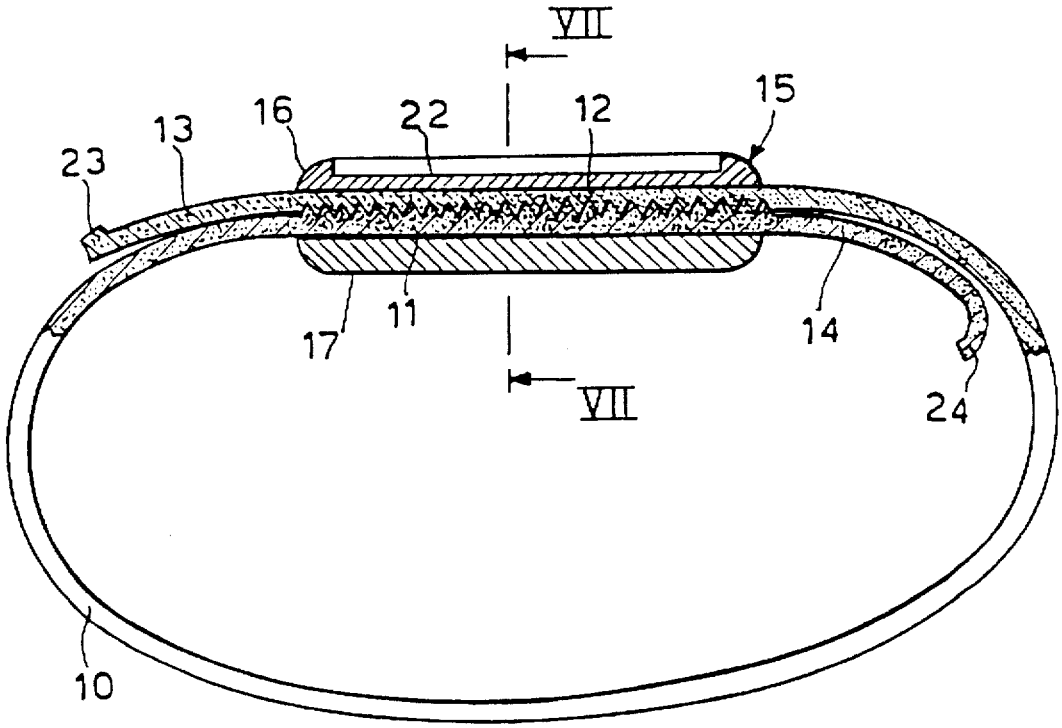
FIG. 6 is a cross-sectional view, similar to FIG. 2, of a device according to a further embodiment of the invention.
Figure 7:
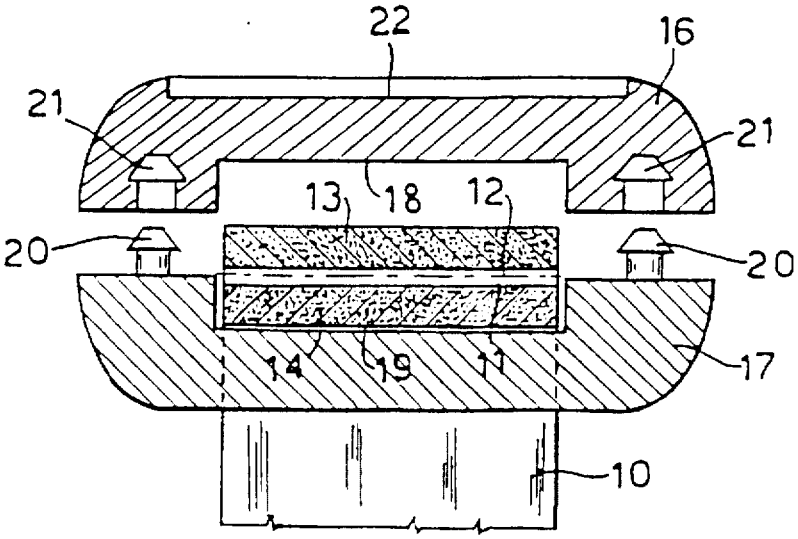
FIG. 7 is a cross-sectional view taken along the line VII—VII of FIG. 6.

A further embodiment of the invention, shown in FIGS. 6 and 7, again provides for the presence of a flexible strap 10, which, however, opposite the two free ends 13 and 14, has sections 11 and 12 of the surface knurled in the shape of a sawtooth, located on opposite faces of the strap 10 itself. The knurled sections 11 and 12 engage reciprocally when the strap 10 is folded back on itself, preventing the reciprocal sliding motion of the ends 13 and 14. The two knurled sections 11 and 12 are kept in reciprocal contact thanks to the presence of a clamping shell 15, consisting of two matching half-shells, upper 16 and lower 17. The two half-shells 16 and 17 have as an example a rectangular shape and extend longitudinally for a length sufficient to allow an adequate reciprocal engagement of the knurled-surface sections 11 and 12 of the strap 10. The internal surfaces of the two half-shells 16 and 17 are provided with two grooves 18 and 19 that allow the passage of the strap 10. The lower half-shell 17 is also provided with small spikes 20 protruding upward that, by simple pressure, can be inserted into the holes 21 in the upper shell 16; countersinkings of the head of the spikes 20 and of the holes 21 facilitate reciprocal engagement, also preventing a subsequent disengagement. The upper surface of the upper half-shell 6 also has a flat portion 22 suitable for acting as a support for storing identification information, according to the same technique used in the previous case.

At the time of admittance of the patient, information relating to him is stored on the flat portion 22 of the upper half-shell 16. The strap 10 is wound, for example on the patient's wrist, and its diameter adjusted by sliding the two end sections 13 and 14; the two half-shells 16 and 17 are then placed over and under the strap 10 and are clamped together by means of a simple finger pressure so that the spikes 20 snap into the holes 21. The strap and the support with the identification information are thus clamped in a permanent manner to the patient's wrist. Two pawls 23 and 24 are placed at the two ends 13 and 14, respectively, of the strap 10 to prevent the shell 15, while sliding longitudinally, from making it possible to open the strap 10.

I claim:

1. Information support for univocal identification of a patient, comprising a flexible strip having ends, strip clamping means for clamping the strip ends together to form an adjustable loop permanently wound around a limb end or the neck of the patient and information storing means for receiving and storing readable patient identification information, said strip clamping means and said information storing means being formed as a single device which can be permanently connected to the flexible strip, characterized in that said single device is formed by a first part having a flat front surface for receiving and storing said patient identification information and a rear surface for contacting one side of the flexible strip and by a second part arranged at an opposite side of the flexible strip and permanently connectable with said first part to clamp the flexible strip against the rear surface thereof, wherein said second part of said single device consists of a hollow element welded to one end of the strip and having an internal bottom surface provided with teeth suitable for being inserted into corresponding longitudinally spaced passing-through holes of the other end of the strip, said hollow element being provided with a peripheral frame and said first part of the single device consists of a flat tag which is snap-inserted into said hollow element by elastic deformation of said peripheral frame.

2. Information support according to claim 1, characterized in that said tag is snap-inserted in a direction perpendicular to a plane oriented parallel to said flat tag.

3. Information support according to claim 1, characterized in that said tag is snap-inserted in a direction parallel to the tag plane.

4. Information support according to claim 1, characterized in that said flexible strip (10) and said single device (3, 6; 16; 17) are made of a plastic material which is non-toxic for man.

5. Information support according to claim 1, characterized in that said patient identification information is recorded on said flat surface (6; 22) in a machine readable digital format.

6. Information support according to claim 1, characterized in that said patient identification information includes human readable information.

7. Information support for univocal identification of a patient, comprising a flexible strip having ends, strip clamping means for clamping the strip ends together to form an adjustable loop permanently wound around a limb end or the neck of the patient and information storing means for receiving and storing readable patient identification information, said strip clamping means and said information storing means being formed as a single device which can be permanently connected to the flexible strip, characterized in that said single device is formed by a first part having a flat front surface for receiving and storing said patient identification information and a rear surface for contacting one side of the flexible strip- and by a second part arranged at an opposite side of the flexible strip and permanently connectable with said first part to clamp the flexible strip against the rear surface thereof wherein each of said strip ends is provided with a knurled portion engageable with the corresponding knurled portion of the other strip end to prevent relative sliding motion of said strip ends, said first and second parts of the single device consisting of respective first and second half-shells which can be slipped and clamped onto said strip and clamped to one another to lock said knurled portions of the strip ends in engaged condition.

8. Information support according to claim 7, characterized in that one (17) of said half-shells (16, 17) is provided with spikes (20) which are snap-inserted into complementarily shaped holes (21) of the other half-shell (16) to clamp the two half-shells (16,17) together.

* * * * *